US009460602B2

(12) United States Patent
Calhoun

(10) Patent No.: US 9,460,602 B2
(45) Date of Patent: Oct. 4, 2016

(54) REMOTE WATER SAFETY DEVICE

(71) Applicant: Laryssa Calhoun, Bedford, MA (US)

(72) Inventor: Laryssa Calhoun, Bedford, MA (US)

( * ) Notice: Subject to any disclaimer, the term of this patent is extended or adjusted under 35 U.S.C. 154(b) by 38 days.

(21) Appl. No.: 14/556,261

(22) Filed: Dec. 1, 2014

(65) Prior Publication Data

US 2015/0154846 A1 Jun. 4, 2015

Related U.S. Application Data

(60) Provisional application No. 61/910,922, filed on Dec. 2, 2013.

(51) Int. Cl.

| | |
|---|---|
| ***G08B 23/00*** | (2006.01) |
| ***G08B 1/08*** | (2006.01) |
| ***G08B 17/00*** | (2006.01) |
| ***G08B 21/08*** | (2006.01) |

(52) U.S. Cl.

CPC ..... *G08B 21/088* (2013.01)

(58) Field of Classification Search

CPC .... G08B 21/088; G08B 25/10; G08B 25/14; G08B 23/00; A61F 13/42; F04D 15/0088; A61B 5/0878

USPC ..... 340/573.6, 539, 604, 573.1, 539.11, 340/539.1, 584, 984, 540

See application file for complete search history.

(56) References Cited

U.S. PATENT DOCUMENTS

| | | | | |
|---|---|---|---|---|
| 6,157,303 | A * | 12/2000 | Bodie | G08B 21/088 340/539.1 |
| 2008/0150733 | A1* | 6/2008 | Snyder | G08B 21/088 340/573.6 |
| 2008/0297176 | A1* | 12/2008 | Douglas | H03K 17/955 324/686 |
| 2011/0241887 | A1* | 10/2011 | McKinney | G08B 21/088 340/573.6 |

* cited by examiner

*Primary Examiner* — Kerri McNally
*Assistant Examiner* — Munear Akki
(74) *Attorney, Agent, or Firm* — Law Offices of Daniel A. Tesler, LLC

(57) ABSTRACT

There is a need in the water sensing alarm field for a device that alerts a supervisor when a child's nose and/or mouth come in contact with water that is easy to reset each time that the system is activated. This water safety device system includes a water alarm device for attachment to the user and alarm receiver device for monitoring by the supervisor. The water alarm device is configured to attach to the user expected to have contact with water and is worn on the user's head. The alarm receiver is configured to be used by the supervisor monitoring the user expected to have contact with water and contains visual, audio, and/or physical alert mechanisms. The water safety device system is activated by a momentary contact with water and sends an alert to the supervisor.

16 Claims, 8 Drawing Sheets

REMOTE WATER SAFETY DEVICE

CROSS REFERENCE TO RELATED APPLICATIONS

This application claims the benefit of U.S. Provisional Patent Application No. 61/910,922 filed Dec. 2, 2013, which is hereby incorporated by reference in its entirety.

FIELD OF THE INVENTION

The present invention relates to water sensing alarms and, in particular, to wearable water sensing alarm devices and systems.

BACKGROUND OF THE INVENTION

Accidental drowning has been a leading cause of unintentional injury death worldwide, particularly for young children. The Center for Disease Control has reported that the highest drowning rate is among children ages 1 to 4. When playing in a shallow body of water, young children can easily lose their balance and submerge their nose and mouth under the surface of the water. Even with close adult supervision, it can be easy to lose sight of a child at a crowded beach or pool. Because of the risk of drowning present when young children are playing in water, even with adult supervision, there is a need for a device to immediately alert adults when a child's nose and/or mouth are in contact with the water.

U.S. Pat. No. 7,554,453 to Snyder et al., identifies a need for a device that detects a potential drowning with users that are permitted to have some water contact. Snyder proposes a water alarm device, including a buoyant alarm unit with a water sensor, for releasable attachment to a user. When a timer, in communication with the water sensor, determines that the duration of water contact with the water sensor has exceeded a predetermined time, the alarm device activates. When activated, the alarm releases from the user and travels to the surface of the water to transmit an alarm to a base station.

The device in Snyder is unsuitable for use by young children being supervised by an adult. The device in Snyder will only activate if submerged for a predetermined amount of time. While it may be safe for older children or adults to submerge their heads for a period of time while in the water, allowing young children to submerge their heads in water for any period of time creates a risk of drowning. Snyder contemplates a predetermined amount of time of thirty or sixty seconds for children under 3 or 4, which would not provide an immediate alert of potential drowning in young children.

The device in Snyder is also designed for releasable attachment to a user and is not suitable for use by a child who could cause the alarm unit to detach in quick succession when playing in water. It would be impractical to have an adult locate and reattach the alarm unit every time it was activated to reset the device system. Snyder does not meet the need for a water safety device that immediately alerts a supervisor that the user's nose and/or mouth has come into momentary contact with water and is easily reset.

Accordingly, there remains a need for a device that alerts a supervisor when a child's nose and/or mouth come in contact with water that is easy to reset each time that the system is activated.

BRIEF SUMMARY OF THE INVENTION

According to embodiments of the present invention, a water alarm device for attachment to the user and alarm receiver device for monitoring by the supervisor. The water alarm device is configured to attach to the user expected to have contact with water. The water alarm device has a water sensing portion, a main circuit board capable of wireless transmission and a waterproof housing with a means to attach the device to the user.

The alarm receiver is configured to be used by the supervisor monitoring the user expected to have contact with water. The preferred embodiment attaches the alarm receiver to the supervisor with a strap and can use visual, audio, and/or physical alert mechanisms.

DETAILED DESCRIPTION OF THE INVENTION

Figure 1:
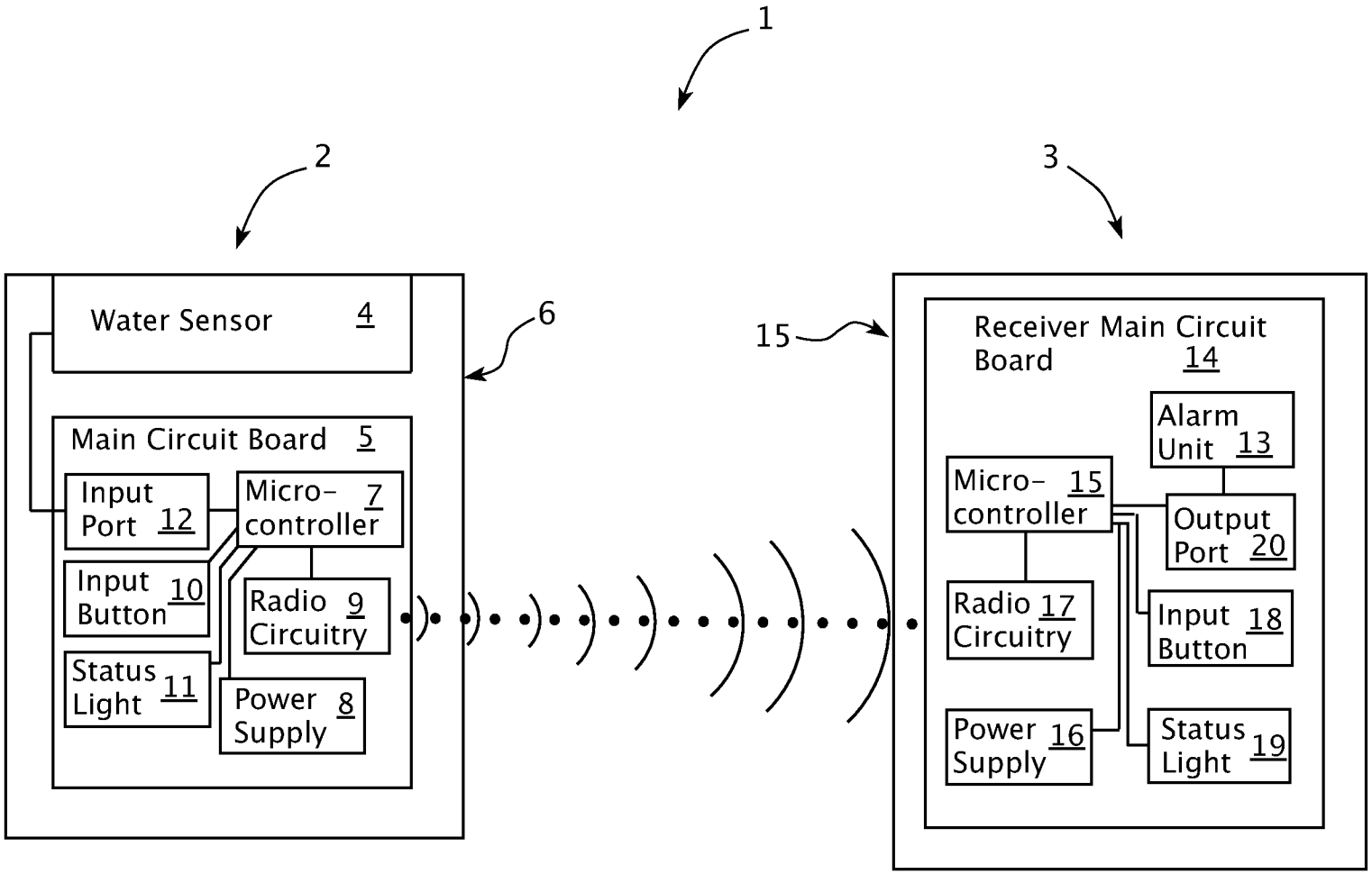
FIG. 1 is a schematic view of the water safety device system.

In FIG. 1, the water safety device system 1 comprises a water alarm device 2 in wireless communication with an alarm receiver device 3. The water alarm device 2 is attached to the person expected to have contact with water or a liquid. The alarm receiver device 3 is used by the person supervising the person with the water alarm device 2.

The water alarm device 2 of FIG. 1 comprises one or more water sensors 4, a main circuit board 5, and a waterproof case 6. The main circuit board 5 comprises a microcontroller 7, a power supply 8, radio circuitry 9, one or more input buttons 10, one or more status lights 11, and an input port 12. The water sensor or sensors 4 are activated by a momentary or continuous contact with water or another liquid. When activated, the water sensor or sensors 4 send a signal to the input port 12 on the main circuit board 5. In the preferred embodiment, the water sensor or sensors 4 are capacitive sensor electrodes, which can be implemented as a second circuit board mounted flush to the interior of the case or as foil strips attached to the interior of the case 6.

The main circuit board 5 uses a microcontroller 7 to convert the signal from the water sensors 4 into a signal capable of being transmitted wirelessly through the radio circuitry 9 component of the main circuit board 5. The signal generated by the microcontroller 7 and transmitted by the radio circuitry 8 can be a radio signal or other type of wireless interface. The preferred embodiment uses a radio transmission, specifically a 1-2 MHz channel within the 2.400 to 2.4835 GHz range, ISM band, and using GFSK modulation. The main circuit board 5 is powered by a power supply 8 which can be a battery, lithium-ion cell, solar panel or other device capable of generating an electric current.

The input button 10 is used for resetting the water safety device system 1. The input button 10 is pressed to reset the system 1 after a water sensor 4 is activated. To avoid an inadvertent reset of the system by the person wearing the water alarm device 2, in the preferred embodiment, the input button 10 is activated for longer than a momentary contact to reset the system. In the preferred embodiment, the water safety device system 1 must be reset by using input button 10 to require the supervisor to check on the person wearing the water alarm device 2 each time it is activated by contact with water. The input button 10 can be manipulated from the outside of the waterproof case 6. The status light 11 illuminates or extinguishes to indicate the operational status of the water safety device system 1 or the water alarm device 2. The status light 11, if used, can be seen from outside of the waterproof case 6.

The alarm receiver device 3 of FIG. 1 comprises a receiver main circuit board 14, and a water resistant case 15. The receiver main circuit board 14 is similar to the main circuit board 5 contained in the water alarm device 2. Instead of using an input port 12, the receiver main circuit board uses an output port 20 in its place. The receiver main circuit board 14 comprises an alarm unit 13 connected to output port 20, a microcontroller 15, a power supply 16, radio circuitry 17, one or more input buttons 18, and one or more status lights 19. The alarm unit 13 can alert the user the user through a visual alert (such as a status light or display), an audio alert (such as a piezoelectric buzzer or speaker), and/or a physical alert (such as a vibration). The preferred embodiment uses a piezoelectric buzzer for the alarm unit 13 and is mounted directly to the receiver main circuit board 14. The alarm unit 13 can be integrated as part of the water resistant case 15 to facilitate the use of a display screen or warning lights.

When the water sensor or sensors 4 are activated on the water alarm device 2, the radio circuitry 17 in the alarm receiver device receives the wireless signal transmitted by the radio circuitry 9 of the water alarm device 2. The signal is sent from the radio circuitry 17 on the receiver main circuit board to the microcontroller 15. The microcontroller 15 processes the signal from the radio circuitry 17 and sends an output signal to the output port 20. The alarm unit 13 is connected to the output port 20. The output signal from the output port 20 activates the alarm unit 13 to alert the user of the alarm receiver device 3.

The receiver main circuit board 14 is powered by a power supply 16 which can be a battery, lithium-ion cell, solar panel, or other device capable of generating an electric current. The input button 18 can be used for turning the alarm receiver device 3 on or off. The input button 18 can be manipulated from the outside of the water resistant case 15. The status light 19 illuminates or extinguishes to indicate the operational status of the water safety device system 1 or the alarm receiver device 3. The status light 19 is mounted directly on the receiver main circuit board 14 in the preferred embodiment and can be seen by the user through a transparent portion of the waterproof case 15. Alternatively, the status light 19 can be remotely mounted on or in the water resistant case 15 and connected to the receiver main circuit board 14 through an electrical connection.

Figure 2:
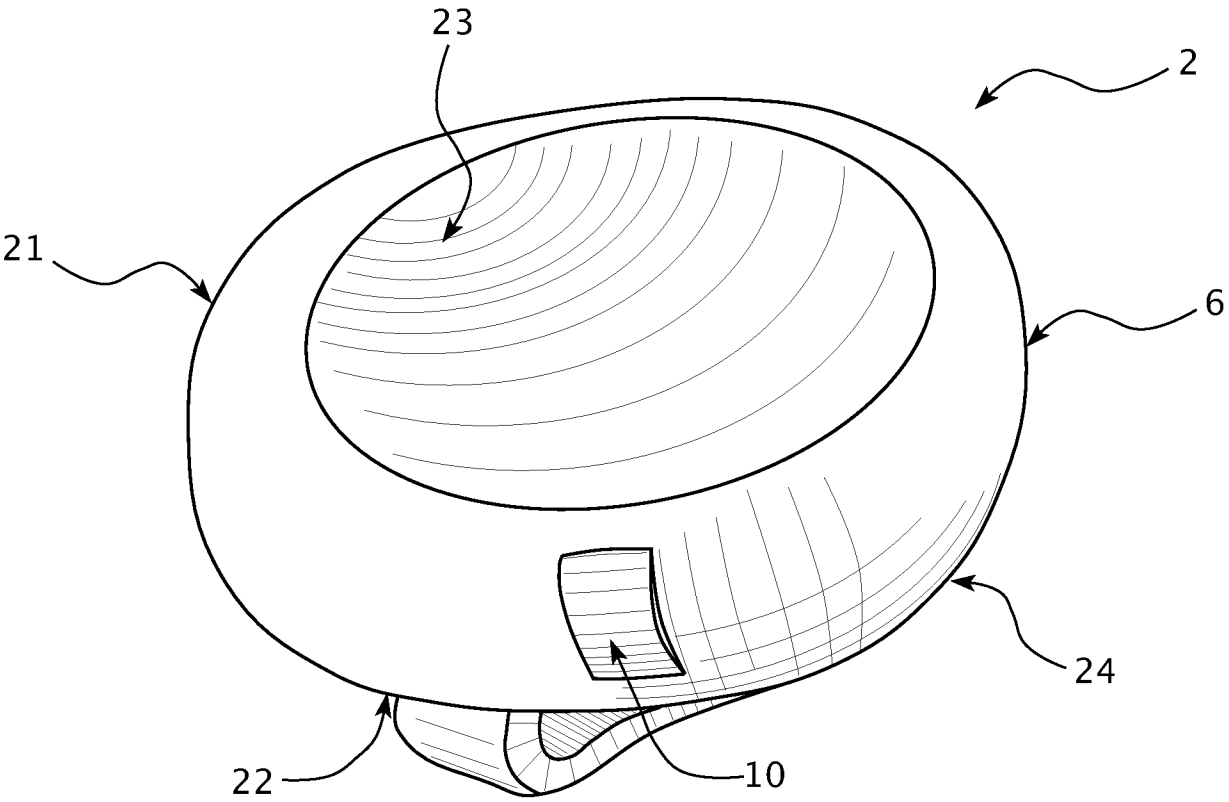
FIG. 2 is a perspective view of the water alarm device.

In FIG. 2, the water alarm device 2 is enclosed in a waterproof housing 6. Housing 6 comprises a lid 21 and a base 22. The lid 21 has a top side 23 and a bottom side 24 where the base 22 mounts. The top side 23 of the lid 21 is concave to increase the effectiveness of the water sensors 4. The top side 23, alternatively, can also have flat recess to increase the effectiveness of the water sensors 4. Mounted through the exterior of the housing 6 is input button 10. The status light 11, if used, would also mount through the exterior of the housing 6.

Figure 3:
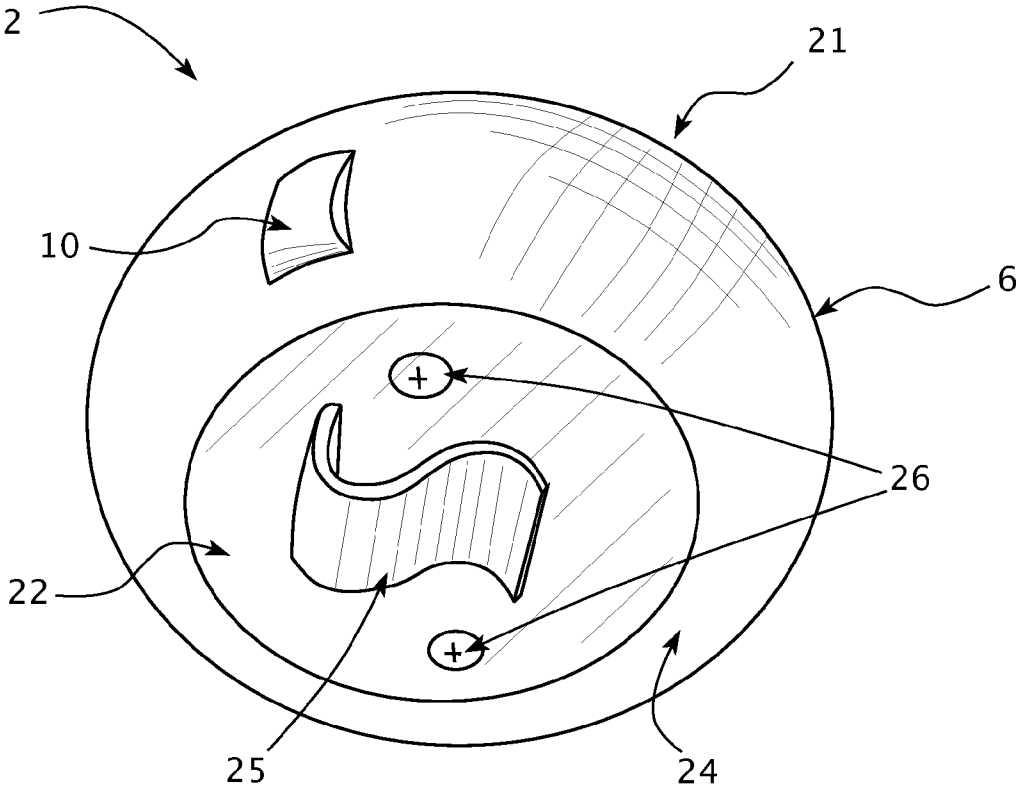
FIG. 3 is an alternative perspective view of the water alarm device.

In FIG. 3 is the housing 6 in an alternative perspective view showing the bottom side of the base 22 in detail. The base 22 is attached to the bottom side 24 of the lid 21 using a plurality of fasteners (screws) 26 and when fastened, provides a waterproof seal. The waterproof seal can be aided by a variety of waterproofing materials, such as gaskets, rubber rings, etc. The base 22 can also be attached to the lid 21 using a variety of other methods, including but not limited to, a single fastener or by molding female threads on the bottom side 24 of lid 21 and corresponding male threads on the edge of base 22 (or vice versa). The lid 21 and base 22 of waterproof housing 6 are capable of separating to allow the replacement of the power supply 8 and/or any other component. The portion of the base 22 that faces the exterior of the waterproof case 6 includes a clip 25 or other mechanical means for attaching the water alarm device 2 to the user. The clip 25 can optionally include an additional sensor built into the clip itself or attached to the base 22 to sense if the water alarm device 2 is removed from the user. This optional sensor would generate an alert through the water safety device system 1, similar to an alert for water contact. The input button 10 can also been seen in this view.

Figure 4:
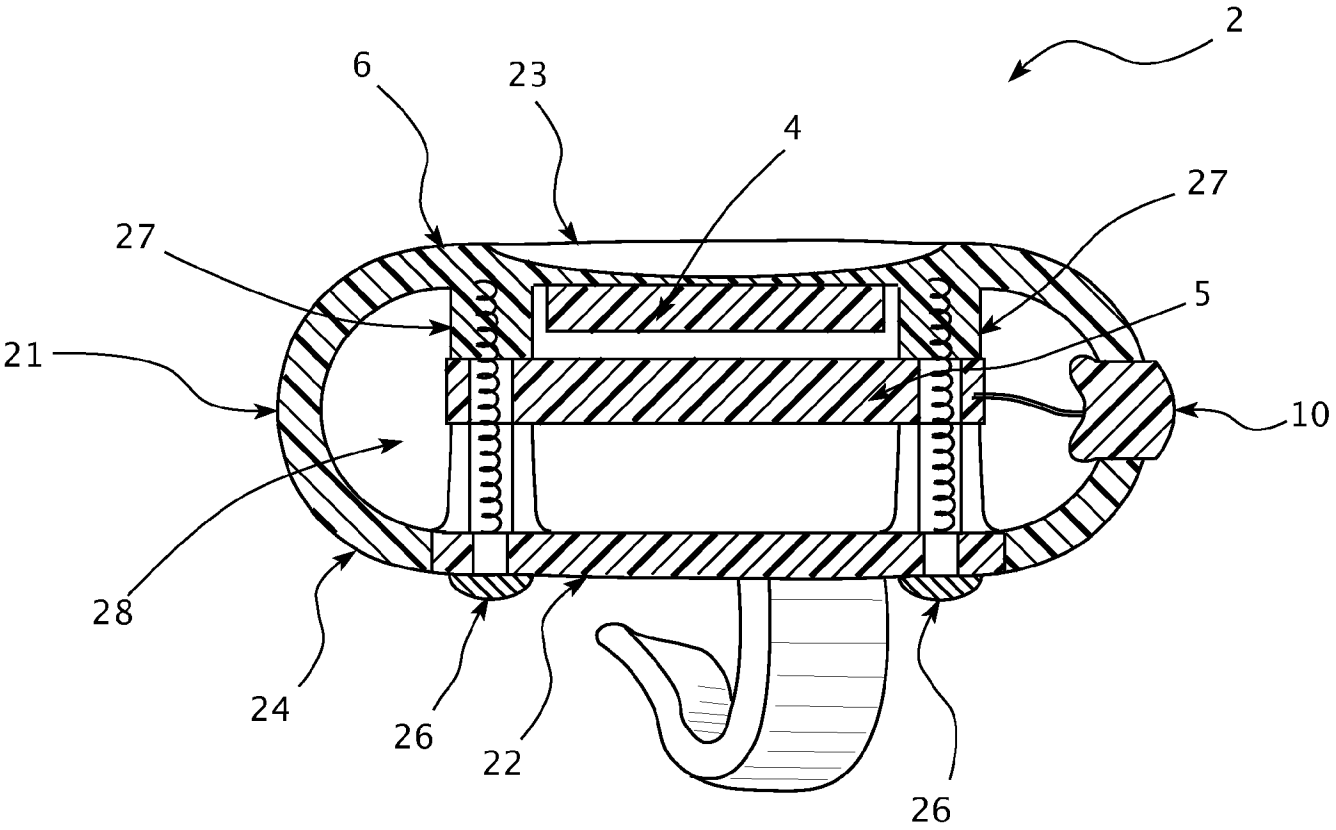
FIG. 4 is a cross-sectional side view of the water alarm device.

In FIG. 4 is a cross-sectional side view of water alarm device 2. The lid 21 is closed on the top side 23 and open on the bottom side 24. The lid 21 has a plurality of female threaded sections 27 molded to the interior to allow for the corresponding fasteners 26 to thread in. When the lid 21 and base 22 are fastened together with the fasteners 26 threaded into the threaded sections 27, there is a void 28 inside the waterproof housing 6.

Inside the void 28 are mounted the water sensor or sensors 4 and the main circuit board 5. The water sensor or sensors 4 are mounted flush to the interior of the lid 21. In the preferred embodiment, the water sensors 4 are mounted on a circuit board and mounted flush to the interior of the lid 21. The interior of the lid 21 has a flat area to accommodate the circuit board of water sensors 4. The corresponding area on the exterior of lid 21 is concave or contains a flat recess to enhance the sensitivity of the water sensors 4. The water sensors are mounted flush against the interior of the lid 21 to allow the case 6 to act as the capacitor dielectric. The main circuit board 5 is mounted between the water sensor or sensors 4 and the base 22. The input button 10 extends through the lid 21 allowing it to be manipulated from the exterior of the waterproof case 6.

Figure 5:
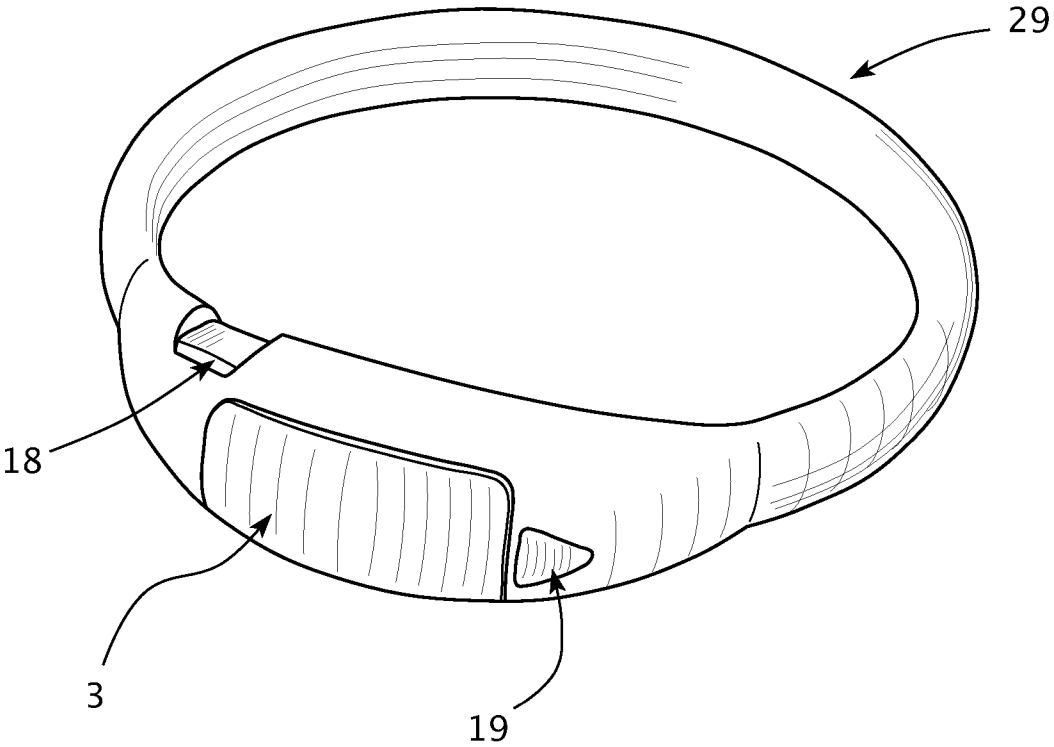
FIG. 5 is a perspective view of the alarm receiver device.

In FIG. 5, the alarm receiver device 3 is removably mounted in a wristband or strap 29. The alarm receiver device 3 can also be mounted to a variety of other devices to keep the alarm receiver device 3 in an optimal location to alert its user. The alarm receiver device 3 can also be permanently integrated into a wristband 29 so that the wristband is part of the water resistant case 15. The input button 18 is mounted through the water resistant case 15 and the wristband or strap 29 to allow for manipulation by the user. The status light 19 is mounted inside the waterproof case 15 and can be seen by the user through a transparent portion of the case.

Figure 6:
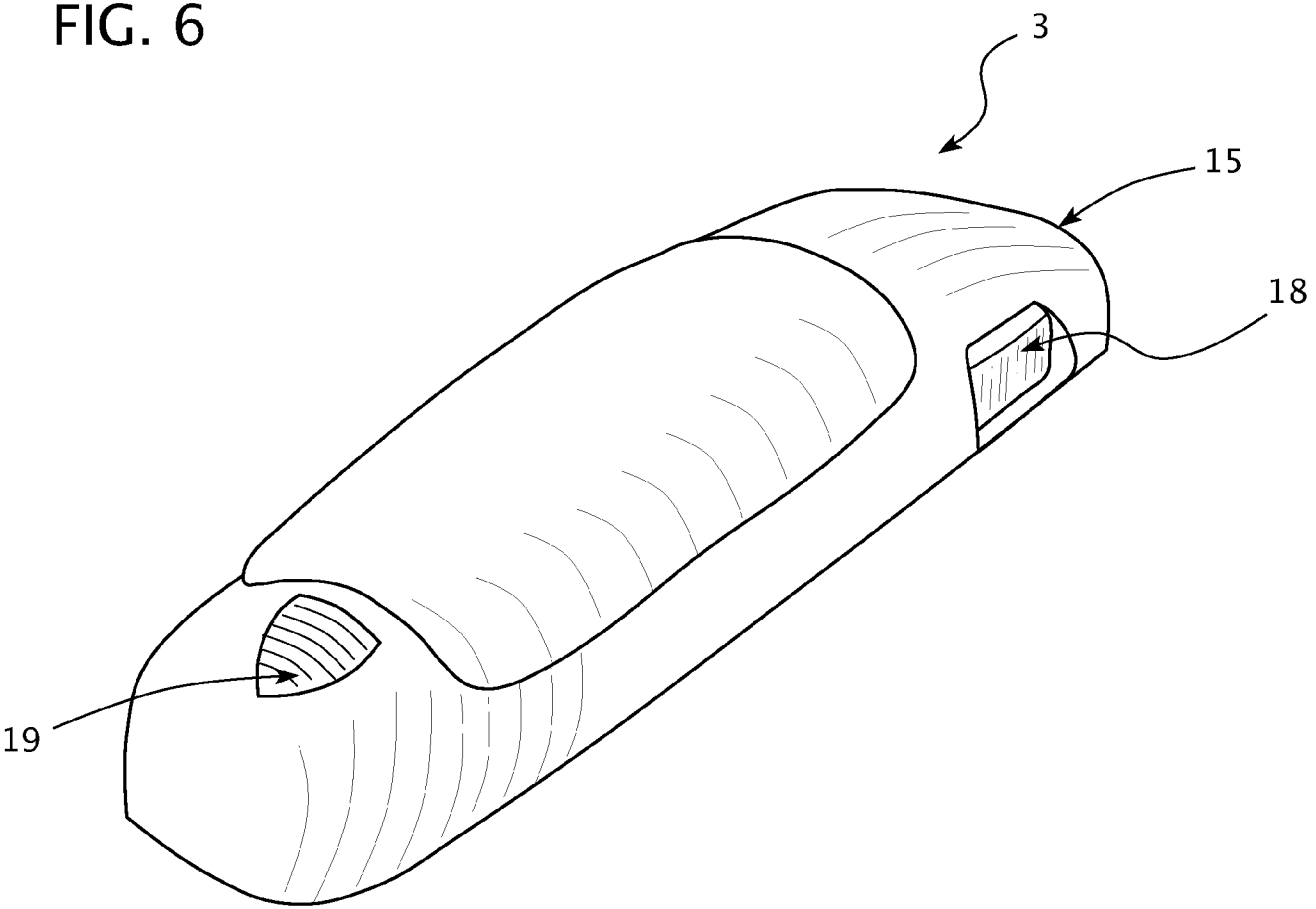
FIG. 6 is an enlarged perspective view of the alarm receiver device separated from the strap.

In FIG. 6 is an enlarged perspective view of the alarm receiver device 3 removed from the wristband or strap 29. Also visible in this view is the input button 18 mounted on the side of the water resistant case 15. The status light 19 is mounted on the receiver main circuit board 14 and can been seen through a transparent portion of the water resistant case 15.

Figure 7:
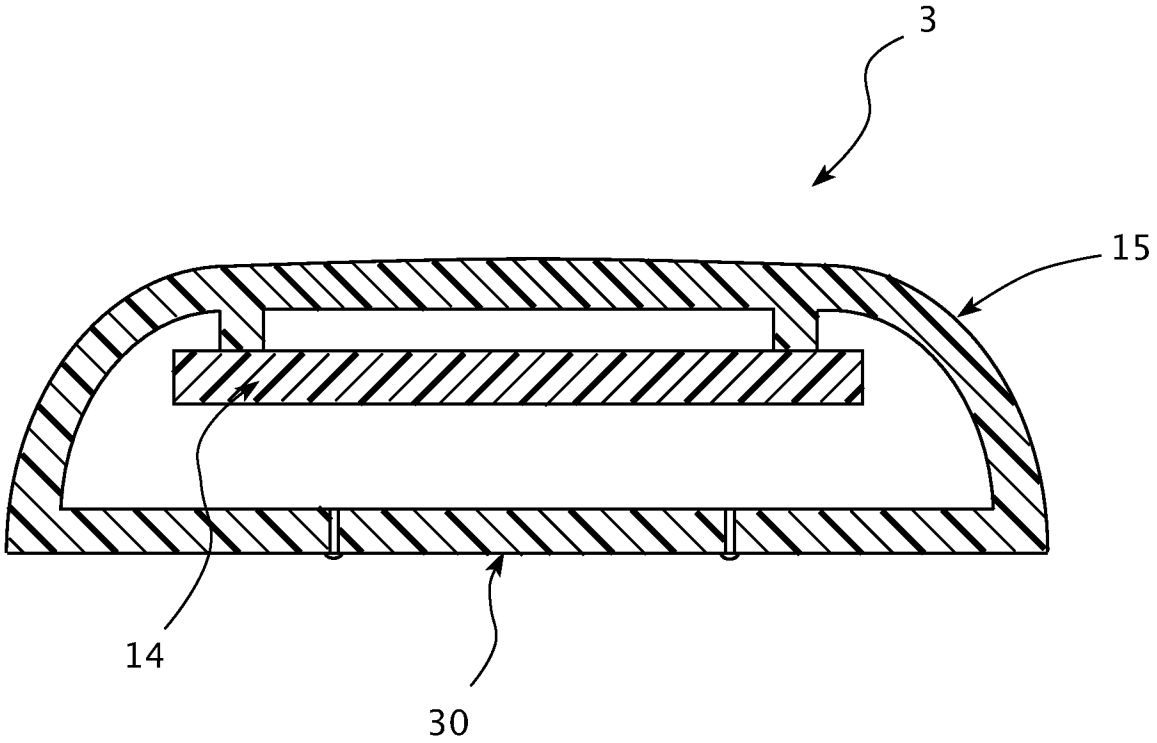
FIG. 7 is a cross-sectional side view of the enlarged alarm receiver device separated from the strap.

In FIG. 7 is a cross-sectional enlarged side view of the alarm receiver device 3 removed from the strap or wristband 29. The water resistant case 15 has an access door 30 mounted on the bottom side. The access door 30 allows for the replacement of the power supply 16 and/or any other component. The access door can be hinged on one edge with a latching mechanism on the opposite edge or a fully removable panel using fasteners. The receiver main circuit board 14 is mounted inside the water resistant case 15.

Figure 8:
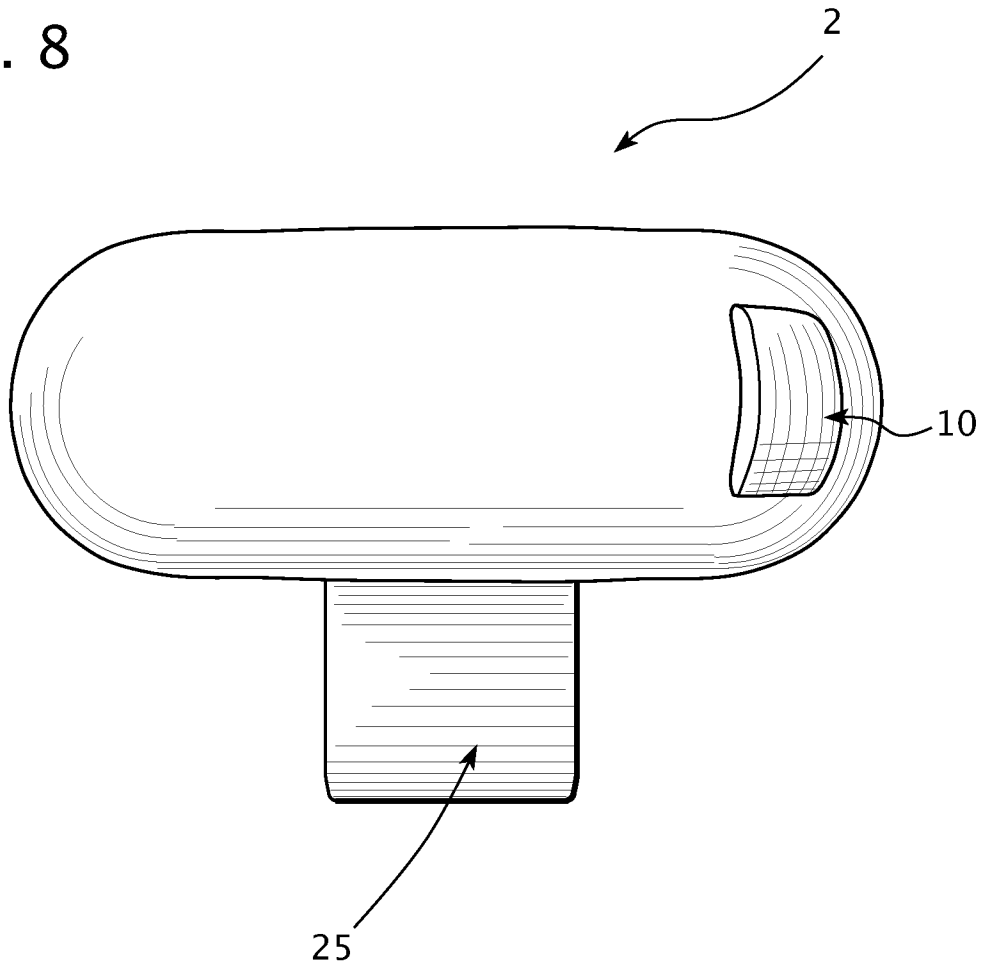
FIG. 8 is an elevation view of the water alarm device.

In FIG. 8 is an elevation view of the water alarm device 2. This view shows the relationship of the input button 10 with the clip 25 in the preferred embodiment.

The entire alarm receiver device 3 can be substituted by any device capable of receiving the alarm signal emitted by the alarm device 2. For example, a smart cellular telephone could use a mobile application to receive the alarm signal from the alarm device 2 and convert the signal into an alert for a person in the vicinity of the smart cellular telephone. Similarly, the alarm signal could be received by a radio or other device. This invention contemplates the user of the alarm receiver device 3 to be near enough to the person using the water alarm device 2 to allow for intervention if drowning is imminent; however, this invention can also be used to transmit an alert to a location outside of the immediate vicinity of the person using the water alarm device 2.

This invention is capable for use in fresh water and salt water, allowing for its use at beaches, lakes, pools, bathtubs and any other standing water. This invention could also be used in other applications that would require an alert when a user comes in contact with a liquid.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A system for sensing water immersion by a first user and alerting a second user, said system comprising:

a first device fixed to a first user, said first device comprising a watertight housing containing at least a water sensor, first controller and wireless transmitter, where said water sensor is electrically connected with a first controller and said first controller is electrically connected with a wireless transmitter;

said housing further comprising a top surface oriented away from said first user and a bottom surface oriented towards said first user, where the exterior of said top surface has a concave portion;

said water sensor further comprising one or more capacitive foil strips attached to the interior of said top surface; and a second device used by a second user, said second device comprising a wireless receiver configured to detect signals broadcast by said wireless transmitter and electrically connected with a second controller, said second controller electrically connected with a means of producing an alert to said second user.

2. The system of claim 1 wherein said water sensor comprises at least one capacitive sensor capable of producing a first signal when in contact with a liquid.

3. A system for sensing water immersion by a first user and alerting a second user, said system comprising:

a first device fixed to a first user, said first device comprising a water sensor electrically connected with a first controller, said first controller electrically connected with a wireless transmitter;

said housing further comprising a top surface oriented away from said first user and a bottom surface oriented towards said first user, where the exterior of said top surface has a concave portion;

a second device used by a second user, said second device comprising a wireless receiver configured to detect signals broadcast by said wireless transmitter and electrically connected with a second controller, said second controller electrically connected with a means of producing an alert to said second user;

where said water sensor comprises at least one capacitive sensor capable of producing a first signal when in contact with a liquid; and where said first device is contained in a housing, said capacitive sensors further comprising one or more foil strips attached to the interior surface of said housing.

4. The system of claim 2 wherein said first device is contained in a housing, said capacitive sensors further comprising one or more circuit boards fixed to the interior surface of said housing.

5. The system of claim 3 wherein said first controller further comprises a means of converting said first signal into a second signal.

6. The system of claim 5 wherein said wireless transmitter comprises a radio transmitter and said wireless receiver comprises a radio receiver.

7. The system of claim 6 wherein said means of producing an alert comprises a speaker.

8. The system of claim 6 wherein said means of producing an alert comprises a vibration generating device.

9. The system of claim 6 wherein said means of producing an alert comprises a light.

10. The system of claim 9 wherein said means of producing an alert further comprises a speaker and a vibration generating device.

11. The system of claim 10 wherein said first device further comprises an electric switch mounted on the exterior of said housing and electrically connected to said first controller.

12. The system of claim 11 wherein said first device further comprises a power source comprising a solar panel.

13. The system of claim 12 wherein said second device further comprises a power source comprising a solar panel.

14. The system of claim 1, wherein said housing further comprises a substantially flat area on the interior of said top surface;

where said water sensors are mounted to a circuit board; and where said circuit board is fixed against the substantially flat area.

15. A system for sensing water immersion by a first user and alerting a second user, said system comprising:

a first device fixed to a first user, said first device comprising a watertight housing containing at least a water sensor, first controller and wireless transmitter, where said water sensor is electrically connected with a first controller and said first controller is electrically connected with a wireless transmitter;

said housing further comprising a top surface oriented away from said first user and a bottom surface oriented towards said first user, where the exterior of said top surface has a substantially flat recessed portion;

said water sensor further comprising one or more capacitive foil strips attached to the interior of said top surface; and a second device used by a second user, said second device comprising a wireless receiver configured to detect signals broadcast by said wireless transmitter and electrically connected with a second controller, said second controller electrically connected with a means of producing an alert to said second user.

16. The system of claim 15, wherein said housing further comprises a substantially flat area on the interior of said top surface;

where said water sensors are mounted to a circuit board; and where said circuit board is fixed against the substantially flat area on the interior of said top surface.

* * * * *